United States Patent [19]

Kubert et al.

[11] Patent Number: 4,709,635

[45] Date of Patent: Dec. 1, 1987

[54] FLUID METERING METHOD AND APPARATUS

[75] Inventors: Vince T. Kubert, Indialantic, Fla.; John S. Richards, Arlington, Tex.

[73] Assignee: Harris Graphics Corporation, Melbourne, Fla.

[21] Appl. No.: 851,232

[22] Filed: Apr. 14, 1986

Related U.S. Application Data

[63] Continuation-in-part of Ser. No. 629,616, Jul. 11, 1984, abandoned.

[51] Int. Cl.[4] ..... B41F 31/04; B41F 33/16

[52] U.S. Cl. ..... 101/426; 101/365

[58] Field of Search ..... 101/365, 350, 349, 351, 101/148, 157, 169, 426

[56] References Cited

U.S. PATENT DOCUMENTS

| | | | |
|---|---|---|---|
| 2,392,706 | 1/1946 | Taylor et al. | 101/365 |
| 2,902,927 | 9/1959 | Ross | 101/365 |
| 3,134,325 | 5/1964 | Worthington et al. | 101/365 |
| 3,353,484 | 11/1967 | Koyak | 101/365 |
| 3,613,576 | 10/1971 | Zell | 101/365 |

*Primary Examiner*—J. Reed Fisher

*Attorney, Agent, or Firm*—Tarolli, Sundheim & Covell

[57] ABSTRACT

A fluid metering system is disclosed for use with a printing press including an array of individual adjustable ink fountain keys for regulating the thickness profile of the ink film supplied to the inker roll by an ink fountain. The fountain keys are spaced along the length of the ink fountain and associated inker roll and each includes a friction wheel fixed thereto. A key actuator is mounted upon a carriage so as to traverse the array of keys. The key actuator includes a drive wheel which engages the friction wheels of the ink keys in sequence as the carriage traverses the array in either direction. The carriage responds to commands as from an operator, an ink preset sensor or an on-press color sensor to move the key actuator along the array to any of the keys requiring adjustment. As the drive wheel engages the friction wheel of each ink key in moving across the array, the key actuator responds to the command signal and rotates the drive wheel at a rate synchronized with the rate of travel of the carriage whereby those keys not requiring adjustment are not rotated. For those keys requiring adjustment, the drive wheel is caused to rotate while in contact with the friction wheel of the key being adjusted.

19 Claims, 13 Drawing Figures

FLUID METERING METHOD AND APPARATUS

CROSS-REFERENCE TO RELATED APPLICATION

This is continuation-in-part application of co-pending application Ser. No. 629,616, filed July 11, 1984 now abandoned.

TECHNICAL FIELD

The present invention relates to a method and apparatus for metering fluid, and is particularly directed to a method and apparatus for metering ink in a printing press by remotely adjusting individual metering keys of a printing press fountain to control a resultant ink film profile on an ink roll.

BACKGROUND ART

To produce high quality printed matter, it is essential that the printing press controllably and consistently deliver ink upon a web or other stock in the printing operation. A number of factors involved in the printing process directly influence the application of ink onto the web and thus affect the resulting appearance of the finished product. For example, such factors include (i) the composition, texture and finish of the web or other material to be printed, (ii) the color, composition and consistency of the ink being used, (iii) the type of ink fountain roll being used, and (iv) the nature of the printed image itself. For any particular set of operating conditions, there is an optimum ink.film profile or thickness across the ink fountain roll which yields a printed image of desired quality.

To achieve a print image of desired quality, it is necessary to control the ink film profile or thickness at a plurality of locations along the ink fountain roll. A conventional printing press includes an ink fountain having a flexible metering blade in close proximity to an ink fountain roll. U.S. Pat. No. 4,008,664 discloses an ink fountain control apparatus for a printing press in which the spacing of a flexible blade from an associated fountain roll is adjustable at a plurality of locations along the fountain roll. In accordance with the U.S. Pat. No. 4,008,664, a plurality of rotatably adjustable keys are provided at spaced locations along the blade. The keys include means bearing against the blade to adjust the position of the blade relative to the associated fountain roll to thereby control the profile of the resulting ink film from the fountain.

Adjustment of fountain keys in previous known systems has been accomplished by manually turning a knurled head disposed on each key. U.S. Pat. No. 4,008,644 discloses a system in which each key is provided with a bidirectional motor operated manually to individually adjust each key from a remote location. Other known systems for adjusting fountain keys have included a travelling carriage with a relatively complex arrangement of clutches and gears which mesh with gear teeth disposed on the keys and selectively rotate a key a slight amount upon passing in one or the other direction.

SUMMARY OF THE INVENTION

In accordance with the present invention, there is provided a fluid metering method and apparatus for adjusting the profile of a fluid film transferred from a fluid fountain to an associated roll. The system is particularly useful in multiple unit, perfecting offset printing presses for adjusting individual keys of a selected fountain of a selected printing unit.

A fluid metering apparatus, in accordance with the present invention, comprises a fountain roll and means for metering fluid on said fountain roll, the metering means including a flexible edge juxtaposed to the fountain roll. The apparatus further comprises a plurality of individually rotatable keys adjustably contacting the flexible edge at spaced locations therealong, the rotational position of each key controlling spacing between an associated section of the flexible edge and the fountain roll, each key including a friction wheel fixed thereto. A carriage is mounted for movement along the keys. First drive means is provided for controlling movement of the carriage. A driveable friction wheel is carried by the carriage and positioned to individually engage the friction wheel of each key as the carriage moves therepast. Second drive means is provided for rotating the driveable friction wheel at (i) a speed and a direction synchronized with the movement of the carriage when passing a key not to be adjusted to roll over such key and (ii) a speed and a direction when at a key to be adjusted to effect a desired spacing between the fountain roll and a section of the flexible edge associated with the key being adjusted.

A method, in accordance with the present invention, for adjusting individual keys of a linear array of such keys in a fluid metering apparatus to maintain a desired fluid profile on a fountain roll as the roll rotates, the fluid metering apparatus including a carriage adapted to move along the keys and key actuating means on the carriage having rotatable means for driveably engaging each of the keys in succession as the carriage moves along the keys, the method comprising the steps of identifying one of the keys to be rotatably adjusted, moving the carriage from a first position to a second position opposite the key to be adjusted, operating the key actuating means to rotate the rotatable drive means drivably engaging the keys at a speed synchronized with the movement of the carriage whereby any keys not to be adjusted remain stationary as the carriage moves therepast from the first to the second position, and operating the key actuating means to rotate the rotatable drive means to rotatably adjust the identified key.

In a preferred embodiment of the present invention, a carriage or positioning unit is mounted upon rails so as to traverse back and forth in a path along a linear array of ink keys. A key drive system affixed to the carriage includes a stepping motor whose output shaft drives an idler gear. Each key includes a drivable friction wheel. The idler gear is positioned to driveably individually engage the friction wheel of each key in succession as the carriage moves therepast. The carriage or positioning unit drive and the key drive system operate in response to appropriate control signals from a processing unit. When adjustment of a particular key is commanded, the carriage moves along the rails and into position for rotating that particular key. While the carriage is moving, the key drive system rotates the idler gear in the direction and at a speed synchronized with the carriage movement so that the idler gear will engage and roll over the friction wheels of those keys not requiring adjustment without causing rotation of the friction wheels. When the carriage or positioning unit arrives at a key to be adjusted, the idler gear engages the friction wheel of that key and the key drive system is instructed to rotate the idler gear such that the friction wheel will, in turn, be rotated in either one direction or the other to make the appropriate change in key position.

Another feature of the invention is the provision of means to sense the rotary position of each key. Each key has an associated magnetic transducer coupled thereto. A Hall effect sensor is carried by the carriage. When a key is being adjusted, a signal is outputted from the Hall effect sensor indicative of the position of the key.

BRIEF DESCRIPTION OF THE DRAWINGS

Other features and advantages of the invention will be apparent to those skilled in the art by reading the following detailed description in connection with the accompanying drawings wherein.

DESCRIPTION OF THE PREFERRED EMBODIMENTS

Figure 1:
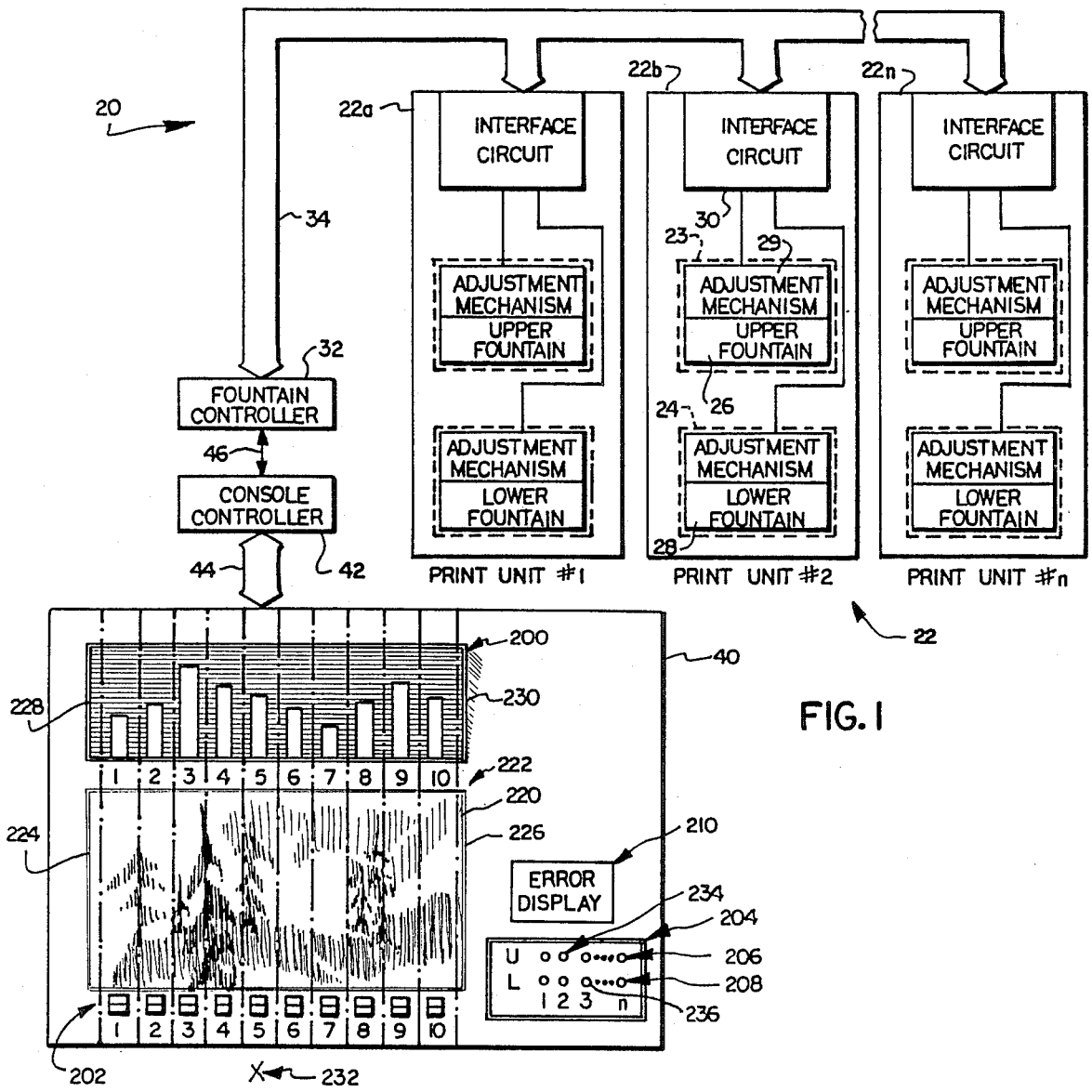
FIG. 1 is a block diagram illustating an ink key control system in accordance with the present invention.

Referring to FIG. 1, a multi-unit, perfecting offset printing press 20 is schematically shown. The printing press 20 includes a plurality of print units 22, individually designated *22a, 22b, . . . 22n,* which operate on a continuous web to print multi-color images as well as text on both sides of the web. Each printing unit 22 includes an upper printing press inker 23 and a lower printing press inker 24 for applying an ink film to an associated blanket cylinder in a known manner. Each upper printing press inker 23 includes an upper fountain 26 for supplying an ink film having a controlled profile. Each lower printing press inker 24 includes a lower fountain 28 for supplying an ink film having a controlled profile.

Each fountain includes an adjustment mechanism 29 that will be described in detail below. Each print unit 22 includes an interface circuit 30 that electrically connects each fountain adjustment mechanism with a fountain controller 32. The fountain controller 32 communicates with each interface circuit via a fountain control bus 34.

An operator console 40 is electrically connected to a console controller 42 by an Input/Output ("I/O") bus 44. The console controller 42 is electrically connected to the fountain controller 32 by a serial bus or link 46.

Figure 2:
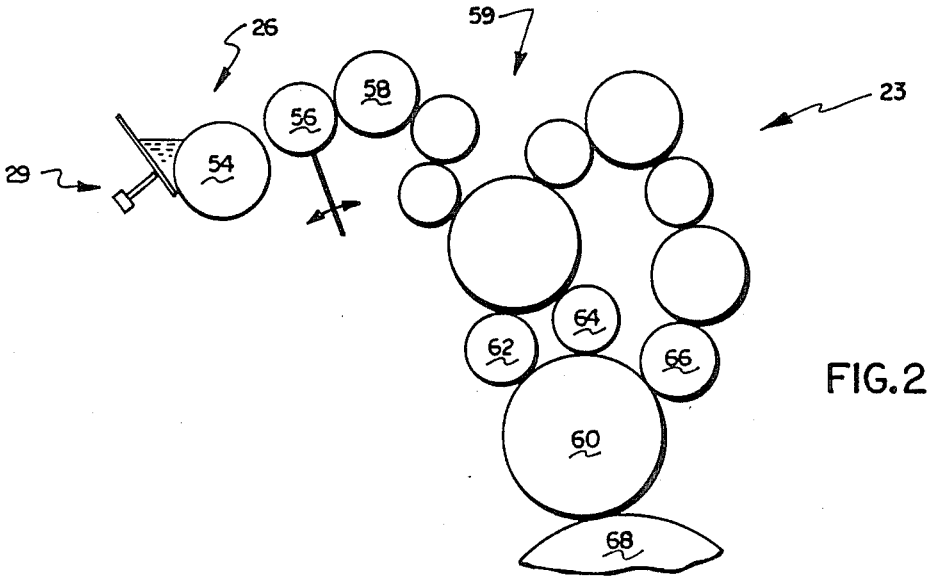
FIG. 2 is a schematic illustration of a printing press inker.

Referring to FIG. 2, an upper printing press inker 23 is schematically illustrated. The inker 23 includes an upper fountain 26 having an associated fountain adjustment mechanism 29 which adjusts the profile of the ink film on its associated fountain roll 54. A ductor roll 56 transfers ink from the fountain roll 54 to a first roll 58 in a train of vibrator and intermediate rolls 59. The ink film is applied to a plate cylinder 60 by ink form rolls 62, 64, 66. The ink film is then transferred from the plate cylinder 60 to an upper blanket cylinder 68.

Referring now to FIGS. 3–7, the adjustment mechanism 29 is shown in detail. The adjustment mechanism 29 includes a travelling carriage or positioning unit 70 upon which is mounted a key actuating unit 72 for engaging and selectively rotating a selected key of a linear array of keys 74 associated with a fountain as the carriage is caused to traverse back and forth along the linear array in either direction as indicated by the arrow 76.

Figure 5:
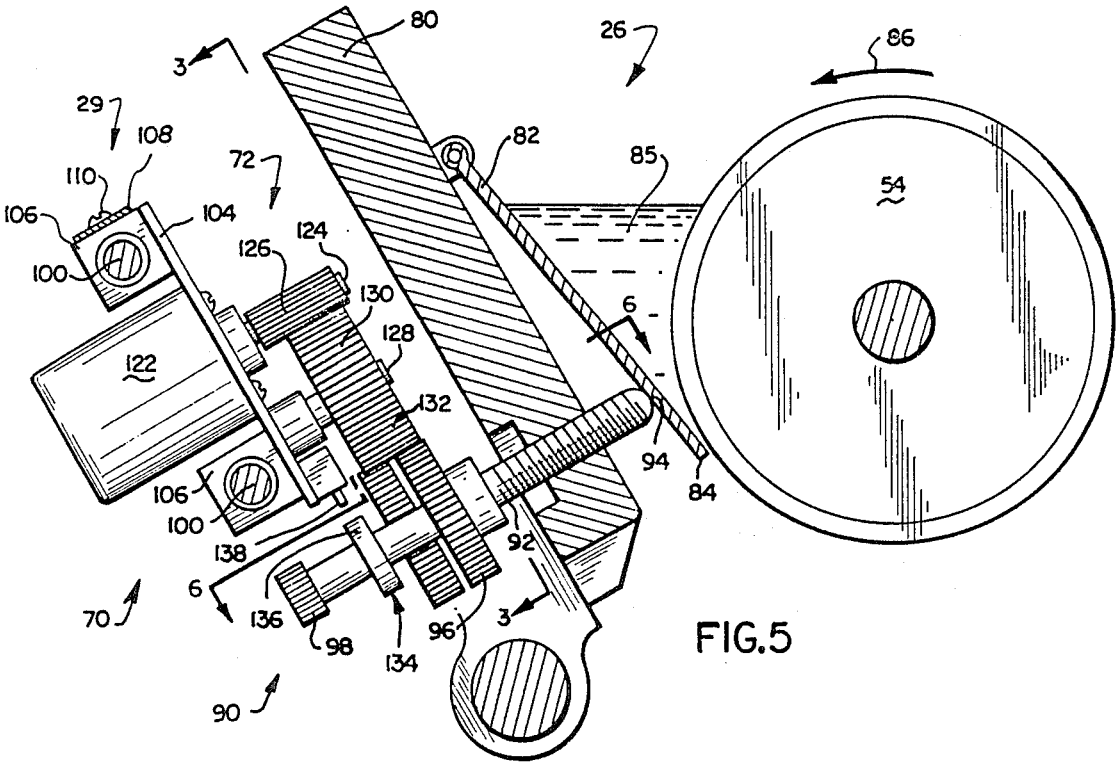
FIG. 5 is an end elevation, partially in section, illustrating a portion of the ink key control system in accordance with the present invention.

Referring to FIG. 5, an ink fountain 26 has an associated ink roll 54 extending laterally across the width of the press in the conventional manner. The ink fountain comprises a base 80 from which a flexible blade 82 is suspended with its lower edge 84 in close proximity to the ink roll 54. The flexible blade 82 and adjacent curved roll surface thus form a cavity within which is maintained a reservoir 85 of ink.

During operation of the press, the ink roll 54 rotates in the direction indicated by the arrow 86, and ink from the reservoir 85 flows through the space between the lower edge 84 of the blade 82 and the roll 54 to create a film of ink upon the surface of the roll 54 whose thickness is determined by the spacing of the blade edge from the roll surface at any point along its length. Thus, as is well known, by precisely controlling the profile of the edge 84 of the flexible blade relative to the roll 54, an ink film having a desired thickness profile can be maintained across the roll 54.

To that end, a plurality of ink flow regulators or keys 74 are positioned at locations spaced laterally along the ink fountain 26 to form a linear array. Each key 90 includes a barrel 92 threaded through the base 80, with a tip 94 projecting beyond the base to engage and support the rear of the flexible blade 82 adjacent the lower edge 84 thereof. Each section of the lower edge 84 is biased against its associated tip 94 by the weight of the ink. Thus, by rotating the threaded barrel 92 of a selected key, the tip 94 of the selected key may be advanced or retracted as desired to thereby control the spacing between the edge 84 of the associated section of the blade and the adjacent surface of the roll 54.

While the keys may obviously be manually adjusted as required, present day printing technology makes remote automatic adjustment of the keys highly desirable. In the aforementioned U.S. Pat. No. 4,008,644 it is suggested that each key might be provided with a small bidirectional motor for this purpose. While such a system is entirely satisfactory, there are certain advantages in being able to employ a single actuating unit for adjusting all of the keys. Thus, in the present device, the barrel 92 of each of the keys 90 extend rearwardly from the base 80 and has affixed thereto a friction wheel 96 by means of which the key is rotated by the key actuating unit 72 as will be hereinafter described. To permit manual adjustment of the keys at such times as necessary, each barrel 92 may have at its outer end a knurled hand wheel 98.

The carriage or positioning unit 70 is supported upon a framework carried by the printing unit that includes a spaced pair of parallel track members 100 extending between supports 102 at either side of the printing unit. A base plate 104 is mounted upon the track members 100 by bearing blocks 106 such as ball bushings so as to be readily movable back and forth along the track members. Controlled movement of the carriage back and forth along the track may be provided by means of a perforated metal drive tape 108 affixed to the bearing blocks 106 as by studs 110. The drive tape is entrained around the drive sprocket 112 at one end of the framework and an idler wheel 114 at the other end. The drive sprocket 112 is carried by the shaft of a stepping motor unit 116. The stepping motor 116 is also referred to as a traversing motor. To insure that traversing movement of the carriage will be precisely timed by suitably controlling operation of the stepping motor drive unit, the drive sprocket includes teeth 118 which are received in mating perforations 120 in the drive tape 108.

The key actuating unit 70 is mounted upon the base plate 104 and includes a key positioning stepping motor 122 whose output shaft carries a pinion drum 124 provided with a surface 126 of a durable friction material. The stepping motor 122 is also referred to as an actuator motor. Also, journalled upon a shaft 128 affixed to the base plate 104 is a rotatable idler gear or wheel 130, likewise having a surface 132 of a durable friction material. The frictional surface 126 of the pinion drum 124 engages the frictional surface 132 of the idler gear 130, and consequently operation of the stepping motor causes rotation of the idler gear in a direction opposite that of the pinion drum.

Figure 6:
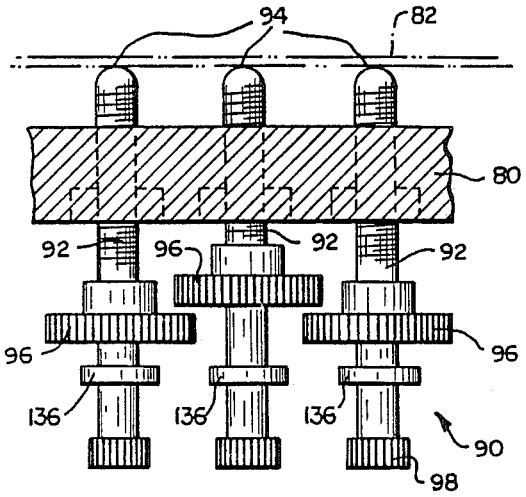
FIG. 6 is a fragmentary view taken along line 6—6 of FIG. 5.

As shown in FIGS. 5 and 6, the individual keys 90 in the linear array of keys 74 are closely spaced laterally across the ink fountain 26 so as to permit precise positioning of the flexible blade 82 in narrow segments across the ink roll 54. To achieve this relatively close spacing, it may be necessary to offset or stagger the position of alternate ones of the friction wheels 96 upon the barrels 92 of the keys. The planes of the adjacent offset friction wheels are closely spaced so that the idler gear 130 will be of sufficient width to engage one after another of the friction wheels in both rows as it is moved back and forth across the linear array of keys 74 by the carriage 70.

A position sensor, shown generally at 134, is provided for monitoring the rotary positions of the keys. A number of prior art devices are available which would be suitable for this purpose. By way of example and as shown in FIGS. 5 and 6, one such device particularly well suited to this application is a magnetic Hall effect device utilizing a multipolar ring magnet 136 affixed on the barrel 92 of each of the keys 90 behind the friction wheel 96. A Hall effect sensor 138 is secured to the base plate 104 of the carriage so that when the key actuating unit 72 is in position to adjust the key, the sensor 138 will be opposite the ring magnet 134 of the key. The sensor 138 will thus detect angular position or rotation of the key through the changing field effected by the rotating ring magnet and produce an electrical signal representative of the angular position or amount by which the key is rotated. A single sensor 138 is adequate for indicating the positions of the each of the plurality of keys 74.

Figure 7:
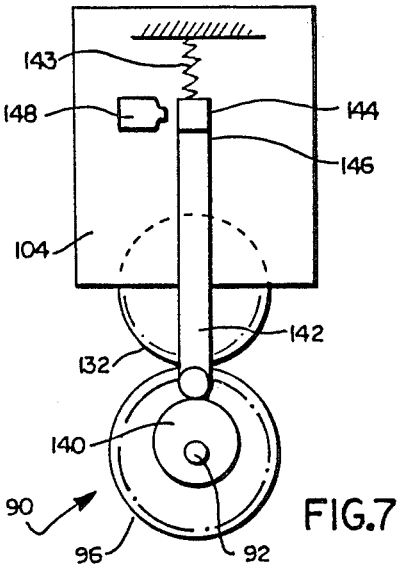
FIG. 7 is a schematic illustration of an ink key position sensor which may be used with the present invention.

FIG. 7 schematically shows another embodiment of a position sensor. Each key 90 includes a cam 140 carried on the barrel 92. A cam follower 142 is mounted for reciprocating motion relative to the base plate 104 and is spring biased by spring 143 against cam 140. A magnet 144 is secured to an end 146 of the cam follower 142. A Hall effect sensor 148 is positioned adjacent the magnet 144. As the key 90 is rotated, the cam follower moves in a linear path. Linear movement of the cam follower 142 moves the magnet 146 relative to the Hall effect sensor 148. The Hall effect sensor outputs an electrical signal indicative of the position of the magnet 144 relative to the sensor which is, in turn, indicative of the rotary position of the key 90. The rotary position of the key 90 can thereby be measured from the output signal from the Hall effect sensor 148.

Figure 8:
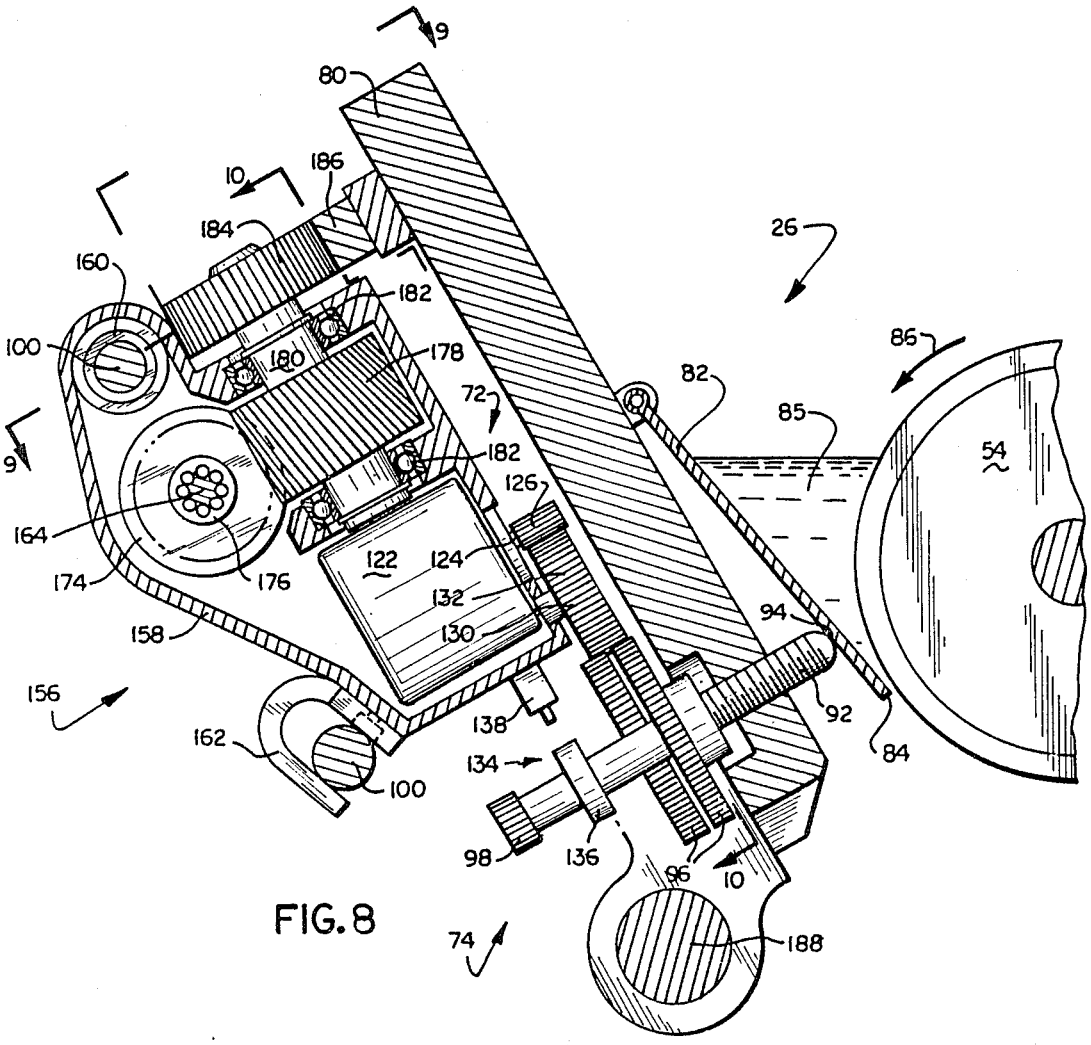
FIG. 8 is an end elevation, partially in section, illustrating another embodiment of the invention.
Figure 9:
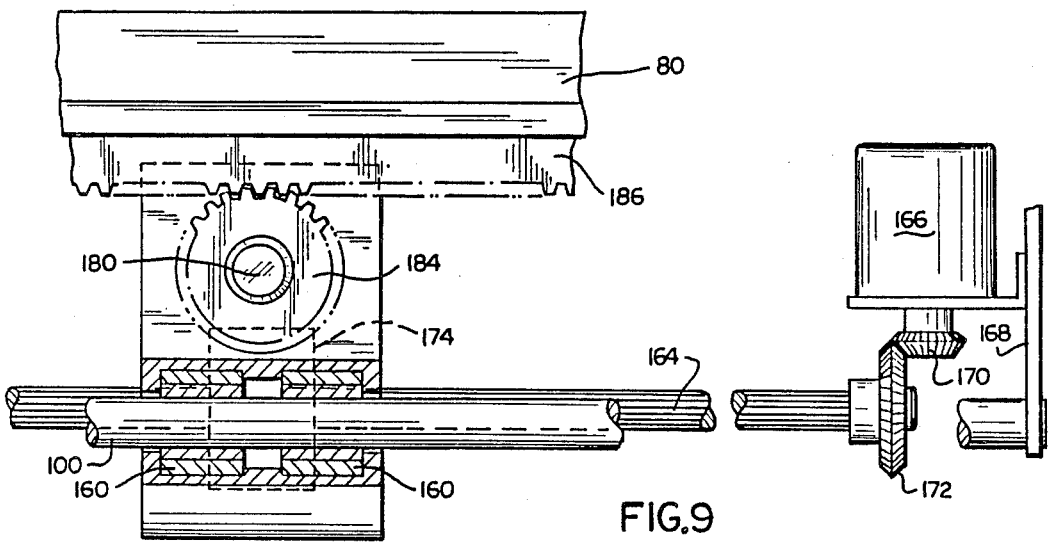
FIG. 9 is a fragmentary view, partially in section, taken along line 9—9 of FIG. 8.
Figure 10:
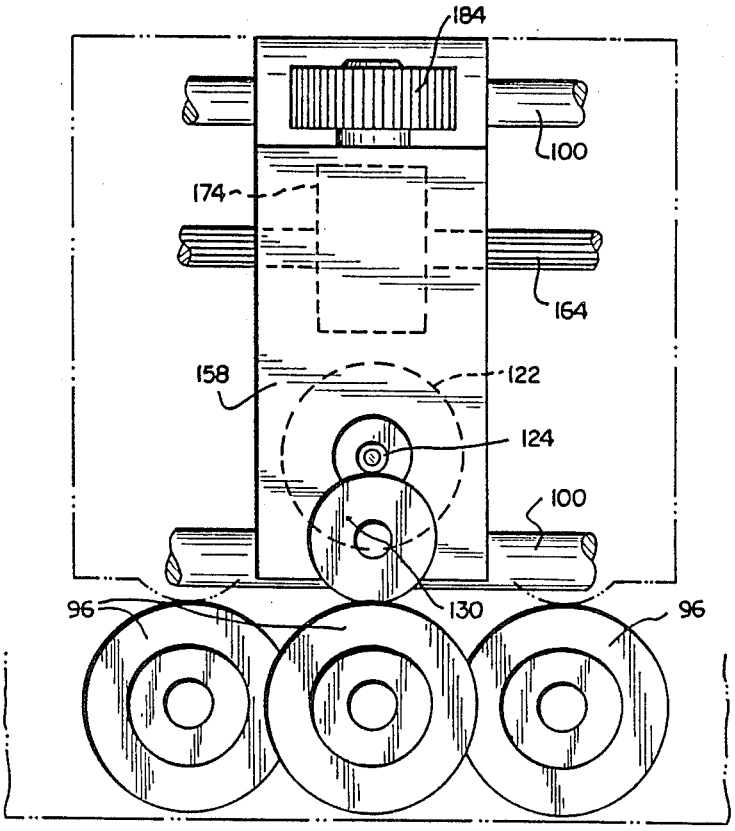
FIG. 10 is a view taken along line 10—10 of FIG. 8.

There is shown in FIGS. 8, 9, and 10 an alternate embodiment of the invention utilizing a somewhat different apparatus for mounting and driving the carriage or positioning unit. In other respects, it is substantially identical to the above-described embodiment and, where appropriate, like numerals are used in identifying like parts.

Referring to FIGS. 8, 9 and 10, a carriage or positioning unit, indicated generally at 156, is mounted upon the track members 100 so as to be movable back and forth along a linear array of keys 74. More particularly, the carriage 156 comprises a box frame 158 slidably mounted upon the upper one of the track members 100 by ball bushing supports 160 and upon the lower track member 100 by yoke 162 affixed thereto. The carriage is moved along the track members 100 by means of a drive mechanism including a splined shaft 164 extending across the press and journalled at the ends (not shown) as in the support members 102. The splined shaft 164 is rotated in either direction in a controlled manner as by a stepping motor 166, mounted upon a bracket 168 affixed to the press framework supports 102, through meshing bevel gears 170 and 172 affixed to the output shaft of the stepping motor 166 and the spline shaft 164, respectively.

A travelling helical gear 174 having a central aperture with mating slots for receiving the splines of the shaft 164 is journalled upon the splined shaft 164 as by an appropriate ball bushing 176 so as to be freely movable linearly along the shaft 164 while being rotatably driven thereby. The travelling helical gear 174 engages a mating gear 178 affixed to a shaft 180 journaled in bearings 182 carried by the box frame 158. Also affixed to the shaft 180 so as to rotate therewith is a pinion gear 184. The pinion gear engages a rack 186 affixed to and extending throughout the length of the fountain base 80. Operation of the motor 166 rotates the splined shaft 164 and the travelling helical gear 174 keyed thereto which, in turn, drives the mating gear 178 in rotation. The shaft 180 rotates to drive the pinion gear 184 in rotation. Since the pinion gear 184 is in meshing engagement with the rack 186, the carriage 156 is caused to move along the linear array of ink keys 74 when the pinion gear 184 is driven in rotation. Since the teeth of the travelling helical gear 174 are intermeshed with the teeth of the mating gear 178, the travelling gear 174 moves with the carriage 156 by sliding longitudinally along the splined shaft 164 on the ball bushing 176. By selectively operating the stepping motor 166 in either direction the carriage 70 may be caused to move back and forth across the linear array of keys 74.

The key positioning stepping motor 122 of the key actuating unit 72 is mounted within the box frame 158, with the pinion drum 124 and idler wheel 130 in position such that the idler wheel frictionally engages each of the friction wheels 96 in succession as the carriage 70 moves back and forth across the linear array of keys 74. Key position detector means 134 includes a multipolar ring magnet 136 affixed to the barrel 92 of each key 90 and a Hall effect sensor 138 carried by the box frame 158 so as to be adjacent the magnet ring of any particular key when the key actuating unit 72 is in position to adjust that key.

In both embodiments of the invention the entire key adjusting mechanism and ink fountain may be pivotally affixed to a shaft 188 carried by the press framework so that it may be swung downwardly from the operative position shown in FIGS. 5 and 8 to a horizontal position for facilitating cleaning and maintenance of the ink fountain 26, ink roll 54 and flexible blade 82.

During a printing run, the thickness profile of the ink supplied to the printed stock is monitored by operating personnel, by a roving on-press color sensor, or other suitable means. When it is determined that adjustment of the ink film thickness is required in one or more areas along the ink roll, the stepping motor drive unit 166 is instructed to move the carriage 70 from its present position to the key 90 controlling the ink film thickness in that area or zone. The stepping motor 122 drives the idler wheel 130 in a direction and at a speed synchronized with the movement of the carriage 70 along the linear array of keys 74 such that when the idler wheel 130 engages the friction wheel 96 of any key not requiring adjustment, the idler wheel rolls over the wheel 96 without causing it to rotate. When the adjusting mechanism is positioned opposite the key requiring adjustment, the stepping motor 122 is energized to rotate the friction wheel 96 of that key by a predetermined amount in a direction appropriate to retract or advance the tip 94 of the key to thereby increase or decrease the thickness of the ink film in that area or zone.

Referring to FIGS. 1 and 11–13, the console 40 includes a display 200 which pictorially illustrates the contour of the edge of the flexible fountain blade at a plurality of locations equal to the number of adjustment keys 90 for a fountain in a printing press unit. For purpose of clarity of explanation, it is assumed that each fountain in a printing unit includes 10 adjustment keys at equal spaced apart locations across the press unit. The display 200 includes bar graphs representing ten adjustable printing zones of a fountain.

A linear array of rocker switches 202 are located on the console 40 with one rocker switch being aligned with each zone of the display 200. The rocker switches 202 are utilized to advance or withdraw an associated key of a fountain being adjusted. Each rocker switch is manually actuatable and has three positions; a first position to advance an associated key, a second neutral position, and a third position to withdraw a key. Each of the rocker switches is spring biased to the neutral position.

A unit select panel 204 includes a plurality of electrically interlocked push buttons oriented in two rows, a first row 206 is designated U for upper fountains, and a second row 208 is designated L for lower fountains. The push buttons are also oriented in n number of columns equal to the number of print units. An error display 210 is utilized for the purpose of displaying error messages to a printing press operator.

Printed matter 220 is placed at a work location 222 between the display 200 and the array of rocker switches 202 such that the ends 224, 226 align with the ends 228, 230 of the display 200, respectively. A press operator stands at a location 232 and examines the printed material 220 and determines if an adjustment must be made in a fountain of the printing press 20 to improve the quality of the printed image 220. Assume, for the purposes of explanation, that the printed image 220 is printed by the upper printing units 23 and that print unit number two prints the color red. Also assume that the press operator determines that more red ink is needed in zone 6 of the print image. To increase the amount of ink in zone 6, the operator must push switch 234 of the select panel 204 which selects the upper fountain of print unit 2. If the operator was going to make an adjustment to the lower fountain in print unit 3, he would depress the switch 236. Going back to the adjustment of the upper fountain for print unit 2, as soon as the switch 234 is depressed, the display 200 illustrates the ink key profile for the upper fountain in print unit 2. To adjust the ink density in zone 6, the operator would actuate the rocker switch 6 to either increase or decrease the ink film profile in zone 6 which, in turn, increases or decreases the ink density in zone 6 of the printed image.

Figure 11:
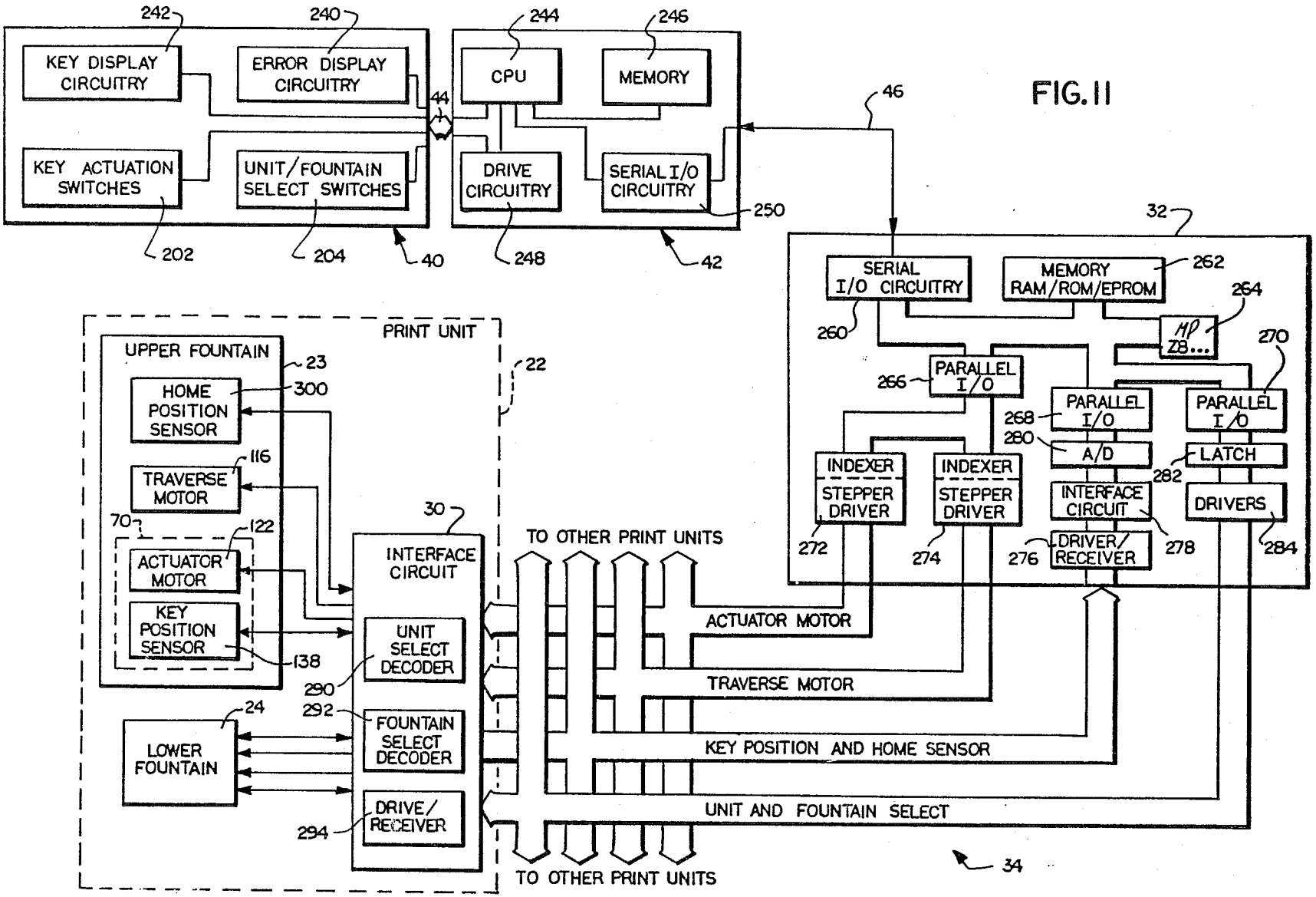
FIG. 11 is a block diagram illustrating, in greater detail, a portion of the ink key control system shown in FIG. 1.

Referring to FIG. 11, the operator console 40 includes the key actuating switches 202, the unit fountain select switches 204, error display circuitry 240 and key display circuitry 242. The console 40 is electrically connected to the console controller 42 through an I/O bus 44. The console controller 42 includes a central processing unit 244, memory circuitry 246 and drive circuitry 248. The central processing unit 244 monitors the key actuation switches 202 and the unit fountain select switches 204.

When a unit fountain is selected by depressing one of the switches 204, the central processing unit 244 retrieves from memory 246 the last set position of the keys for the selected unit fountain. The central processing unit 244 then outputs, through the drive circuitry 248, electrical signals to the key display circuitry 242 indicative the values of the key positions obtained from the memory 246. These values are displayed on the display 200. If a key actuation switch 202 is operated, the CPU 244 outputs an adjustment command to the fountain controller 32 through serial I/O circuitry 250 and serial bus 46.

The fountain controller 32 includes serial I/O circuitry 260 which receives serial information from the console controller 42. The serial I/O circuitry 260 converts the serial information to parallel information for use by the fountain controller 32. The fountain controller 32 further includes memory 262 including random access memory ("RAM"), read only memory ("ROM") and eraseable programmable read only memory ("EPROM"), a microprocessor 264 and three parallel input/output circuits 266, 268, 270. Also included in the fountain controller 32 is an indexer/stepper driver 272 used to drive the actuator motor 122, and an indexer/-stepper driver 274 used to drive the traversing motor 116. A driver/receiver 276 receives signals from the key position sensor 138 and a home sensor from a selected fountain of a selected print unit. An interface circuit 278 is connected to the driver/receiver which communicates with an A–D converter 280 for converting the received analog signals from the key position sensor and the home sensor into digital information. The output of the A–D converter is connected to the parallel I/O circuit 268.

When the CPU 244 of the console controller 42 detects actuation of a unit fountain select switch 204, this information is sent through the serial I/O circuitry 250 over the serial bus 46 to the fountain controller 32. The controller 32 receives the information through its serial I/O circuitry 260. The received information is processed by the microprocessor 264 and is communicated through the parallel I/O circuit 270 to a latch 282 which latches the unit/fountain select information. The select information is outputted from the fountain controller 32 through drivers 284.

The fountain controller is connected to each of the print units 22 by the fountain control bus 34. Each of the print units 22 includes an interface circuit 30 which comprises a unit select decoder 290, a fountain select decoder 292, and driver/receiver circuitry 294. Each print unit 22 has its own separate address. When a print unit and fountain has been selected through one of the push buttons 204, the address of the selected print unit and fountain is outputted from drives 284. A unit select decoder 290 of each print unit 22 monitors the outputs of the drivers 284 and determines whether or not its address has been outputted.

Once a unit select decoder of a print unit 22 determines that it has been addressed, the associated fountain select decoder is enabled and decodes which fountain within that print unit is being addressed. Assuming that the upper fountain is selected, the actuator motor 122 and the traverse motor 116 for that upper fountain are enabled to respond to the outputs of the stepper drivers 272, 274. The fountain controller 32 drives the actuator motor 122 at a speed and in a direction synchronized with the movement of the carriage 70 driven by the traverse motor 116 to rotate the idler wheel 130 so it rolls over friction wheels 96 of keys not to be adjusted. The fountain controller 32 drives the traverse motor 116 until the carriage 70 is positioned at a key to be adjusted as requested by the key actuation switches 202. The fountain controller 32 then drives the actuator motor 122 in a direction responsive to the direction of adjustment requested through the key actuation switches 202. The actuator motor 122 is continuously driven until the key actuation switch 202 is released by the press operator.

The key position sensor 138 outputs its electrical signal which is communicated through the driver/-receiver circuit 294 to the microprocessor 264 through the circuitry 276, 278, 280 and 268. The position of the key being adjusted is communicated back to the console controller 42 through the serial bus 46 and to the central processing unit 244 through the serial I/O circuitry 250. The CPU 244 updates the key position in its memory 246 and simultaneously changes the display 200 in the zone of the key being actuated. If the position of the key is inconsistent with the commands being outputted to the actuator motor 122, the fountain controller 32 outputs an error signal back to the console controller 42 which outputs an error message through the error display circuitry 240 to the error display 210 on the console 40.

The position of the carriage 70 for any fountain of any print unit is known through use of the memory 262 of the controller 32. Also, a home position sensor 300 can be located at the end of each fountain to generate a signal indicative of the carriage being at the end position. The home position sensor can be located on one of the supports 102 at a location which permits actuation by the carriage 70 when the carriage abuts against that support.

Figure 12:
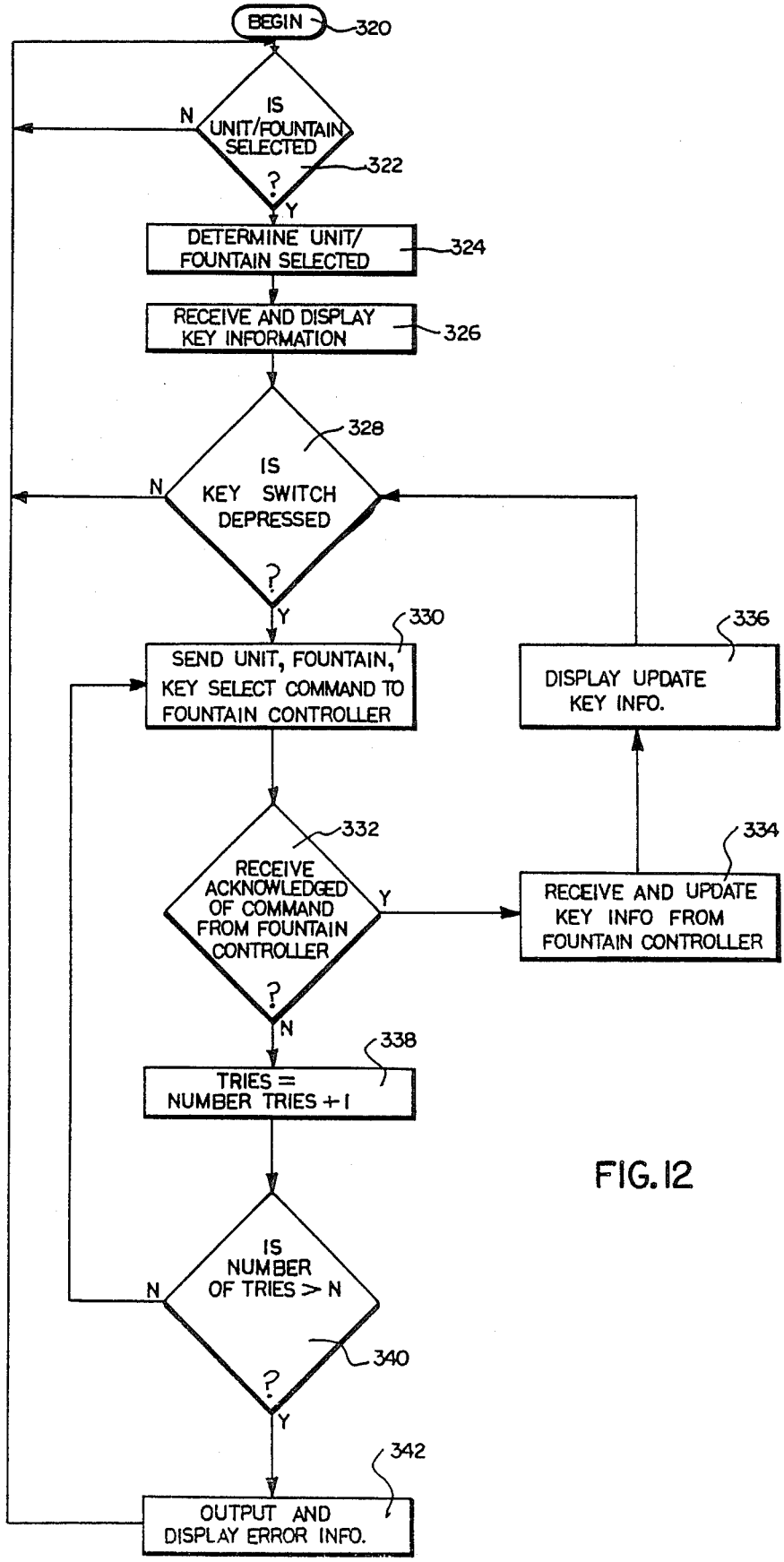
FIG. 12 is a flow chart diagram illustrating partial operating steps of the ink key control system in accordance with the present invention.

FIG. 12 is a flow chart which depicts the operation of the console controller 42. The program begins at step 320. A determination is made in step 322 as to whether the unit/fountain switch 204 has been selected. If a unit/fountain is not selected, the program loops back until a unit/fountain is selected. If a unit/fountain is selected, the program proceeds to step 324 where it is determined which unit/fountain has been selected. In step 326 the central processing unit 244 retrieves from memory 246 the last known profile information, i.e., key positions, for the selected fountain of the selected print unit and the information is displayed through drive circuitry 248 and display circuitry 242 on the display 200. A determination is made in step 328 as to whether a key switch 202 has been actuated. If no key switch 202 has been actuated, the program loops back to step 322. If a key 202 has been actuated, the central processing unit 244 in step 330, outputs a command through the serial I/O circuitry 250 and the serial bus 46 to the fountain controller 32 identifying the unit and fountain selected and the key actuation command.

A determination is made in step 332 as to whether the fountain controller 32 has received the command outputted in step 330. If the determination in step 332 is affirmative, the program proceeds to step 334 where it waits to receive the new position of the key adjusted and updates the new key position in the memory 246. The updated information of the key position being adjusted is displayed in step 336 and the program loops back to step 328 to determine if a key is being actuated by the operator.

Once the operator releases the switch of the key being adjusted, the program loops from step 328 back to step 322. If the determination in step 332 is negative, the central processing unit 244, in step 338, counts the number of times the command in step 330 has been outputted to the fountain controller 32. In step 340, a determination is made if the number of tries exceeds a predetermined number n. If the number of tries does not exceed the number n, the program loops back to step 330 and the command is again outputted to the fountain controller 32. If the number of tries in step 340 is determined to be greater than the number n, the program proceeds to step 342 where an error message is outputted by the central processing unit 244 through the error display circuitry 240 to display an error message on the error display 210 of console 40.

Figure 13:
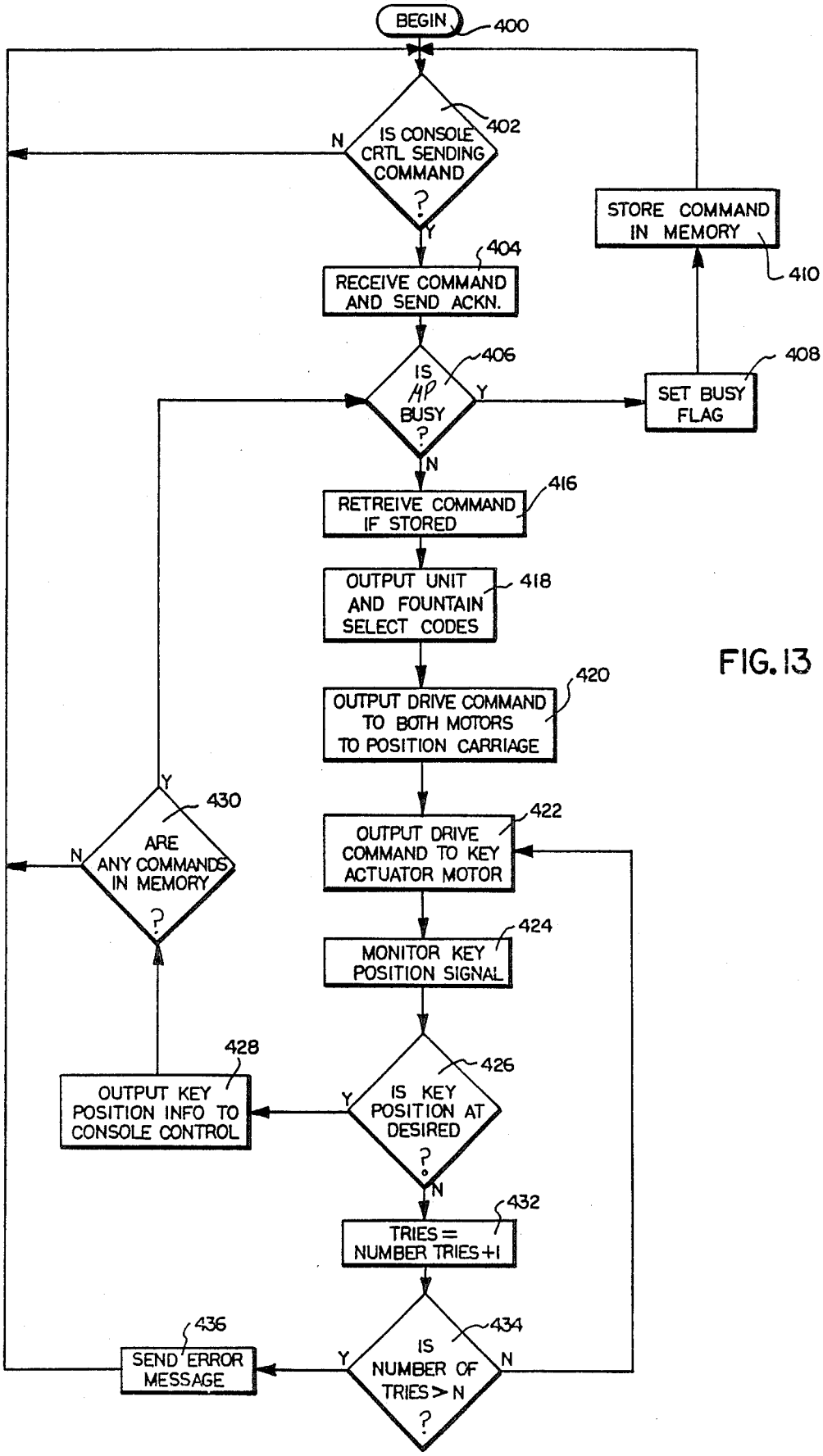
FIG. 13 is a flow diagram illustrating other operating steps of the ink key control system in accordance with the present invention.

The operation of a fountain controller 32 is depicted in the flow chart of FIG. 13. The program begins at step 400. A deterimination is made in step 402 as to whether the console controller 42 is sending an adjustment command. If the detemination is negative, the program loops back upon itself until an affirmative determination is made. Once a command is sent from the console controller 42, the program proceeds to step 404 in which the microprocessor 264 receives the command and issues an acknowledgement of the receipt back to the console controller.

In step 406, a determination is made as to whether the microprocessor 264 is busy. If the microprocessor is busy, a busy flag is set in step 408. The program then proceeds to step 410 where the microprocessor stores the received command at a specific address location within the memory 262. The program then loops back to step 402. Once as the microprocessor is no longer busy, the program would jump to step 406 where the determination would be negative.

The program proceeds to step 416 in which a command is retrieved from memory if it had been stored in step 410. If a command is received from the console controller 42, the microprocessor is not busy and there are no commands in memory, step 416 would be skipped and the program would proceed directly to step 418. In step 418 the microprocessor 264 outputs the unit and the fountain selected codes through the parallel I/O circuit 270. The select information is latched in the latch 282 and outputted to the print units via the driver circuit 284. In step 420 the microprocessor outputs motor drive commands to indexer 272 of the actuator motor and the indexer 274 of the traversing motor. Once the carriage is at the location of the key being adjusted, the microprocessor 274 outputs a drive command signal in step 422 to the indexer 272 of the actuator motor to drive the actuator motor in a direction appropriate to adjust the selected key in accordance with the command inputted by the press operator.

The microprocessor monitors the position of the key being adjusted in step 424 by receiving the signal from the Hall effect sensor through the driver/receiver card 276. A determination is made in step 426 as to whether the position of the key being adjusted is at the proper rotational position after the actuator motor drive command has been completed. If the key being adjusted is in the proper position, the program proceeds to step 428 where the microprocessor 264 outputs through its serial I/O circuit 260 the new position of the key being adjusted to the console controller 42 through the serial bus 46.

A determination is made in step 430 as to whether anymore commands to be executed are stored in memory. If further commands are stored in memory, the program loops back to step 406 where the other commands will be executed. If the determination in step 430 is negative, the program loops back to step 402 where it awaits another command from the console controller 42.

If the determination in step 426 was negative, the micrprocessor keeps track of the number of times it has tried to adjust the selected key. A determination is made in step 434 as to whether the number of tries exceeds a predetemined number n. If the number of tries does not exceed the predetermined number, the program loops back to step 422 where the microprocessor 264 again outputs a drive command to the actuator motor to attempt to again adjust the selected key. If the number of tries in step 434 exceeds the predetermined number n, the microprocessor 264 sends an error message in step 436 back to the console controller 42. The program then loops back to step 402. The error message sent in step 436 will be displayed on the console at the error display 210 to inform the operator that the key adjustment command he has inputted has not been correctly executed.

Figure 3:
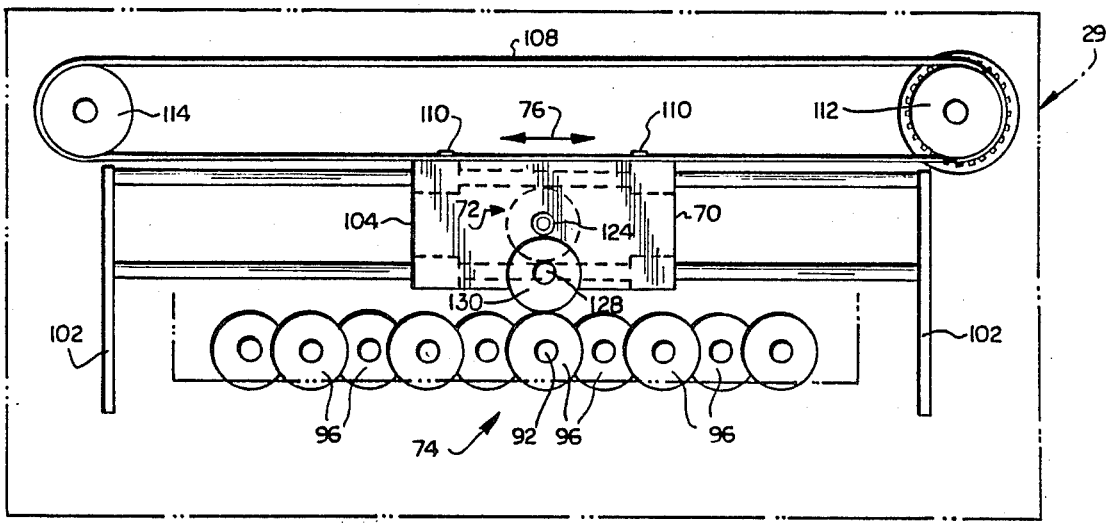
FIG. 3 is a view taken along line 3—3 of FIG. 5.
Figure 4:
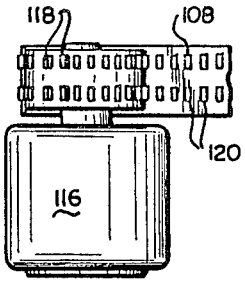
FIG. 4 is a view of a drive unit for the positioning unit or carriage.

The microprocessor 264 controls the traversing motor 116 and the actuator motor 122 in a predetermined relationship such that the wheel 130 rolls over friction wheels 96 of keys not to be adjusted while the carriage is traversing the linear array of keys on its way to a key to be adjusted. Referring to FIG. 3, assume that the carriage 70 is being driven to the right (as viewed in the figure) at a rate of X in/sec. Also, assume that the surface 126 has a diameter $=D_1$, surface 132 has a diameter $=D_2$ and friction wheel 96 has a diameter $=D_3$, where $D_1$, $D_2$ and $D_3$ are measured in inches. To have the wheel 130 roll over a wheel 96 so as not to move the wheel 96, the wheel 130 must be driven in rotation clockwise at a rate according to the following equation:

$$rev/sec = X\ in/sec \cdot (1\ rev/\pi D_2)$$

To drive the wheel 130 clockwise at such a rate, the wheel 124 must be driven in a rotation counterclockwise at a rate according to the following equation:

$$rev/sec = ((D_2/D_1) \cdot X\ in/sec) \cdot (1\ rev/\pi D_2)$$

which can be reduced to $$rev/sec = x\ in/sec \cdot (1\ rev/\pi D_1)$$

Once the carriage gets to the key to be adjusted, the motor 122 is actuated in a direction appropriate to advance or withdraw the key to make the adjustment responsive to the operator's input through the console 40. Accurate synchronization is possible between the traversing motor and the key actuating motor because of several factors. These factors include: (i) both motors are stepping motors which are predictably responsive to drive pulses, (ii) the traversing motor drives the carriage through the perforated tape 108 described above, and (iii) the wheel surfaces of the key actuating unit prohibit slippage between members.

This invention has been described with reference to preferred embodiments. Modifications and alterations may occur to others upon reading and understanding this specification. It is our intention to include all such modifications and alterations insofar as they come within the scope of the appended claims.

For example, the invention has been described with reference to an operator observing the printed image and inputting fountain key change requests via the rocker switches 202. It is contemplated that the key adjustment operation could be fully automated. Such a systen would include an image scanning device that would monitor the printed image at a plurality of locations or zones and output electrical signals indicative of the ink density of the monitored image. A computer would monitor the electrical output signals from the scanning device and generate adjustment commands to a fountain control of similar arrangement as 32. Such an automated system would make needed adjustments on a continuous basis. The control logic to run an automated system could be easily patterned from the control arrangement outlined above and is well within the ability of one skilled in the art upon reading and understanding this specification.

Having described specific preferred embodiments of the invention, the following is claimed:

1. A fluid metering apparatus comprising:

a fountain roll;

means for metering fluid on said fountain roll as said fountain roll rotates, said metering means including a flexible edge juxtaposed to said fountain roll;

a plurality of individually rotatable keys adjustably contacting said flexible edge at spaced locations therealong, rotational position of each key controlling spacing between an associated section of said flexible edge and said fountain roll, each key including a friction wheel fixed thereto;

a carriage mounted for movement along said keys;

first drive means for controlling movement of said carriage;

a drivable friction wheel carried by said carriage and positioned to individually engage the friction wheel of each key as said carriage moves therepast; and second drive means for rotating said drivable friction wheel at (i) a speed and a direction synchronized with the movement of the carriage when passing a key not to be adjusted to roll over such key and (ii) a speed and direction when at a key to be adjusted to effect a desired spacing between the fountain roll and a section of the flexible edge associated with the key being adjusted.

2. The fluid metering apparatus of claim 1 further including rotary position indicating means for sensing the rotary position of a selected key and for generating an electrical signal indicative of the sensed rotary position.

3. The fluid metering apparatus of claim 2 wherein said rotary position indicating means includes a magnetic field sensor carried by said carriage and field generating means for generating a magnetic field at said magnetic field sensor having a characteristic indicative of the rotary position of a selected key.

4. The fluid metering apparatus of claim 1 wherein said carriage is mounted on spaced apart track members substantially parallel with said flexible edge and wherein said first drive means includes an endless tape secured to said carriage and entrained about a sprocket and an idler wheel and a stepping motor to drive said sprocket.

5. The fluid metering apparatus of claim 1 wherein said second drive means includes a stepping motor carried by said carriage.

6. The fluid metering apparatus of claim 1 wherein each of said rotatable keys comprises a barrel threaded through a support member with a tip projecting forwardly to bear against said flexible edge and a rearward extension having its friction wheel secured thereto.

7. A fluid metering apparatus including a rotatable roll and metering means extending therealong for metering fluid on said roll, said metering means including a flexible edge in close proximity to the surface of said roll, a plurality of independently adjustable keys disposed across said flexible edge, each of said keys being rotatable, a section of said flexible edge moving closer to said roll upon rotation of an associated key in one direction and moving farther from said roll upon rotation of said associated key in the other direction to thereby regulate the thickness profile of said fluid deposited across the surface of said roll as said roll rotates, a carriage mounted for movement back and forth along said keys, key actuating means on said carriage for adjusting said keys, said key actuating means including means driveably engaging each of said keys in succession as said carriage moves along said keys, first driving means for moving said carriage in response to a command in either direction from a first position to a second position located at one of said keys to be adjusted, and second driving means for driving said key actuating means at a speed synchronized with the rate of travel of said carriage as said carriage moves from said first to said second position so that keys engaged by said key actuating means between said first and second position remains stationary.

8. The fluid metering apparatus of claim 7 wherein said carriage is mounted on track members, said means for moving said carriage comprising an endless tape affixed to said carriage and entrained about a sprocket and an idler wheel, and a stepping motor driving said sprocket.

9. The fluid metering apparatus of claim 7 wherein each said key includes a friction wheel, and said key actuating means comprises a stepping motor and means to couple said stepping motor to said friction wheel of each of said keys in succession as said carriage moves along said line of keys and drive a selected friction wheel by frictional contact therewith.

10. The fluid metering apparatus of claim 7 wherein each said key comprises a barrel threaded through a support member with a tip projecting forwardly to bear against said metering means, and a rearward extension to which is affixed a friction wheel adapted to be driven by said key actuating means for rotating said barrel.

11. The fluid metering apparatus of claim 10 wherein said key actuating means comprises a reversible stepping motor and an idler wheel driven thereby, said idler wheel being positioned to engage in succession the friction wheel of each said key as said carriage moves along the line of keys.

12. The fluid metering apparatus of claim 7 further including a position detector for indicating the rotary position of each of said keys.

13. The fluid metering apparatus of claim 12 wherein said position detector comprises a magnetic field sensor affixed to said carriage so as to be opposite a key when said key actuating means is in position to adjust that key, and means on each said key for producing a magnetic field whose intensity varies at said sensor as said key is rotated.

14. The fluid metering apparatus of claim 7 wherein said carriage is mounted for reciprocating movement on track members, said means for moving said carriage comprising a drive shaft extending across said fountain, a travelling helical gear mounted on said drive shaft for rotation therewith while being freely movable along said drive shaft, a mating gear affixed to a stub shaft on said carriage and intermeshed with said travelling helical gear, a pinion gear affixed to said stub shaft, and a rack extending along and affixed to the base of said fountain and intermeshing with said pinion gear whereby rotation of said drive shaft causes said carriage to move along said track members.

15. The fluid metering apparatus of claim 7 further including means for selecting a key to be actuated, and means for driving said key actuating means in response to a command to rotate said selected key.

16. A fluid metering apparatus including a rotatable roll and a metering means extending therealong for metering fluid on said roll, said metering means including a flexible edge in close proximity to the surface of said roll, a plurality of independently adjustable keys disposed across said flexible edge, a section of said flexible edge moving closer to said roll upon adjustment of an associated key in one direction and moving farther from said roll upon adjustment of said associated key in the other direction to thereby regulate the thickness profile of the fluid deposited across the surface of said roll as said roll rotates, a carriage mounted for movement back and forth along said keys, and key actuating means carried by said carriage for selectively adjusting said keys, said key actuating means including drive means for frictionally driving a selected key, each of said keys being rotatably adjustable and including a barrel to which is affixed a friction wheel positioned to be driveably engaged by said drive means as said key actuating means moves therepast, and said drive means including a rotatable drive member adapted to driveably engage each of said keys separately, and said apparatus further includes means for rotating said drive member at a speed and in the direction synchronized with the movement of said carriage whereby said drive member rolls over the friction wheel of any of said keys not to be adjusted without causing rotation thereof and said means for rotating said drive member rotates said drive member at a speed and in a direction to rotate the friction wheel of a selected key in response to a command.

17. The fluid metering apparatus of claim 16 further including a position detector for indicating the adjusted position of each of said keys.

18. The fluid metering apparatus of claim 17 wherein said position detector comprises a magnetic field sensor affixed to said carriage and positioned opposite a key when said key actuating means is in position to adjust that key, and means on each said key for producing a magnetic field that varies at said sensor as said key is adjusted.

19. In a fluid metering apparatus, a method for adjusting individual keys in a linear array of such keys rotatably engaging a flexible blade juxtaposed an associated fountain roll to maintain a desired fluid profile deposited on the roll as the roll rotates, the fluid metering apparatus having a carriage adapted to move along the keys and key actuating means on the carriage including rotatable drive means for driveably engaging each of the keys in succession as said carriage moves along the keys, said method comprising the steps of:

(a) identifying one of said keys to be rotatably adjusted;

(b) moving said carriage from a first position to a second position opposite said key to be adjusted;

(c) operating said key actuating means to rotate said rotatable drive means driveably engaging said keys at a speed synchronized with the movement of said carriage whereby any keys not to be adjusted remain stationary as said carriage moves therepast from said first to said second position; and (d) operating said key actuating means to rotate said rotatable drive means to rotatably adjust said identified key.

* * * * *